US006378791B1

(12) United States Patent
Perry et al.

(10) Patent No.: US 6,378,791 B1
(45) Date of Patent: Apr. 30, 2002

(54) SPRAY WAND FOR CLEANING BOAT HULLS

(76) Inventors: Marvin Wayne Perry; Anton Theodore Bociek, both of 522 Pinellas Bayway, Apt. 208, Tierra Verde, FL (US) 33715

( * ) Notice: Subject to any disclaimer, the term of this patent is extended or adjusted under 35 U.S.C. 154(b) by 25 days.

(21) Appl. No.: 09/753,445

(22) Filed: Jan. 3, 2001

(51) Int. Cl.[7] ..... B05B 9/08; B05B 7/02

(52) U.S. Cl. ..... 239/532; 239/525; 239/530; 239/280; 239/280.5; 239/550; 239/566; 239/754

(58) Field of Search ..... 239/525, 530, 239/532, 280, 280.5, 550, 560, 561, 566, 754

(56) References Cited

U.S. PATENT DOCUMENTS 2,563,300 A * 8/1951 Aker ..... 239/566
4,899,940 A * 2/1990 Leaver ..... 239/530
5,115,951 A 5/1992 Leslie et al.
5,335,855 A 8/1994 Borod
5,566,858 A * 10/1996 Ducker, III ..... 239/566 X
5,573,187 A * 11/1996 Proctor ..... 239/532
5,964,419 A * 10/1999 Lovett ..... 239/532
6,079,640 A 6/2000 Merritts

* cited by examiner

*Primary Examiner*—Robin O. Evans
(74) *Attorney, Agent, or Firm*—Larson & Larson, P.A.; James E. Larson

(57) ABSTRACT

A water spray device for cleaning the hull of a boat is disclosed. The spray device includes a handle and wand portion. The handle portion has an angled portion separating an upper and lower part, a channel formed through the handle and a top and bottom open end. The top end engages a hose connected to a water source. A shut-off valve is disposed within the handle channel proximal to the top end. The wand portion is an elongated tube having an channel formed therein, an open top end for engaging the handle bottom end, a closed bottom end and a plurality of spray nozzles disposed along the wand. Water enters the handle portion, flows into the wand portion and out the spray nozzles. A user of the novel water spray device simply positions the spray nozzles towards the boat hull from the deck of the boat while holding the spray device and walks around the perimeter of the boat to quickly, easily and thoroughly clean the boat hull.

20 Claims, 5 Drawing Sheets

SPRAY WAND FOR CLEANING BOAT HULLS

BACKGROUND OF THE INVENTION

1. Field of the Invention

The present invention relates generally to liquid spray devices. More particularly, it relates to a liquid spray wand attachable to a water hose for use in cleaning boat hulls.

2. Description of the Prior Art

Liquid spray devices, and in particular, water spray wands, are known in the prior art. Such devices can be employed for a wide variety of uses. Water spray wands typically connect to a water hose which in turn connects to a water source, such as a water spout. Some spray wands are configured as a single rigid elongated member, such as those used in pressure cleaning systems. These devices typically have a single outlet port which sprays water from a pressurized water source. The spray pattern is usually narrow so that the concentrated water stream spraying from the device can clean debris from a surface area.

Other spray devices are used merely to inject a water or liquid source in a hard to reach area. For example, Applicant is aware of spray wands having a single outlet port which are used to clean gutters attached to the edge of roof surfaces. The high pressure output of the spray device clears debris from the channel of the gutters. Another device used for hard-to-reach areas includes a device for watering plants positioned high above a person's head. This device typically has a single low pressure output which slowly injects water into the potted plant.

Applicant is also aware of at least one water spray device which is used to clean a vehicle. In particular, U.S. Pat. No. 6,079,640 to Merritts discloses a spray device configured to clean the underside of an automobile. The device includes a single continuous Z-shaped body member having a plurality of spray nozzles formed along a distal end which inserts underneath the automobile. Although this device may be useful in cleaning the underside of an automobile, it is limited in its intended use due to its configuration. Accordingly, this prior art device can not be used or modified to be used for other vehicles, such as, for example, boats. Further, it is not adjustable or extendable and therefore is limited in that it can only reach a certain amount of surface area of the vehicle to be cleaned.

An improved liquid spray device is needed which can be adjusted and extended for cleaning surfaces which are hard to reach. In particular, a device is needed which can be used to clean the sides of boat hulls from the deck surface of the boat. Currently, when a boat operator is finished operating their vessel, they typically wish to rinse the boat clean, especially when the boat has been used in a salt water environment. Since salt is known to quickly corrode most surfaces, it is imperative that the vessel be given a fresh water rinse after each use. Unfortunately, no devices in the prior art permit a boat operator to rinse the boat hull quickly, easily and thoroughly. Most operators attempt to rinse the boat hull with a standard garden hose. If the hull is a deep V-style hull, this can prove to be extremely difficult. Further, the boat operator risks being injured by hanging over the gunnel of the boat that is being rinsed. If the boat is a large hull vessel, then most likely the operator will not be able to rinse the entire hull with the garden hose. Clearly, an improved device for cleaning boat hulls is needed.

SUMMARY OF THE INVENTION

We have invented an improved liquid spray device. Our novel device is intended to be used as a water spray wand for use in cleaning boat hulls. Our spray wand permits a boat operator to quickly, easily and thoroughly clean the hull of a boat from the deck of the boat. The spray wand of the present invention can attach to a standard garden hose which is typically used at boat docks and marinas.

The novel spray wand of the present invention includes a handle and a wand portion. A hand grip can be employed along the handle generally at a angled portion of the handle. The angled portion can be static or adjustable. The handle is adapted to connect to the garden hose or other water source and can include a two position shut-off valve or finger trigger. The wand portion attaches to the handle and includes a plurality of spray nozzles. Extensions can be inserted between the handle and the wand portion, depending on the size of the vessel, for extending the wand portion and its spray nozzles formed therein. A novel spray pattern emitting from the spray nozzles ensures that the user does not get wet when using the present invention.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
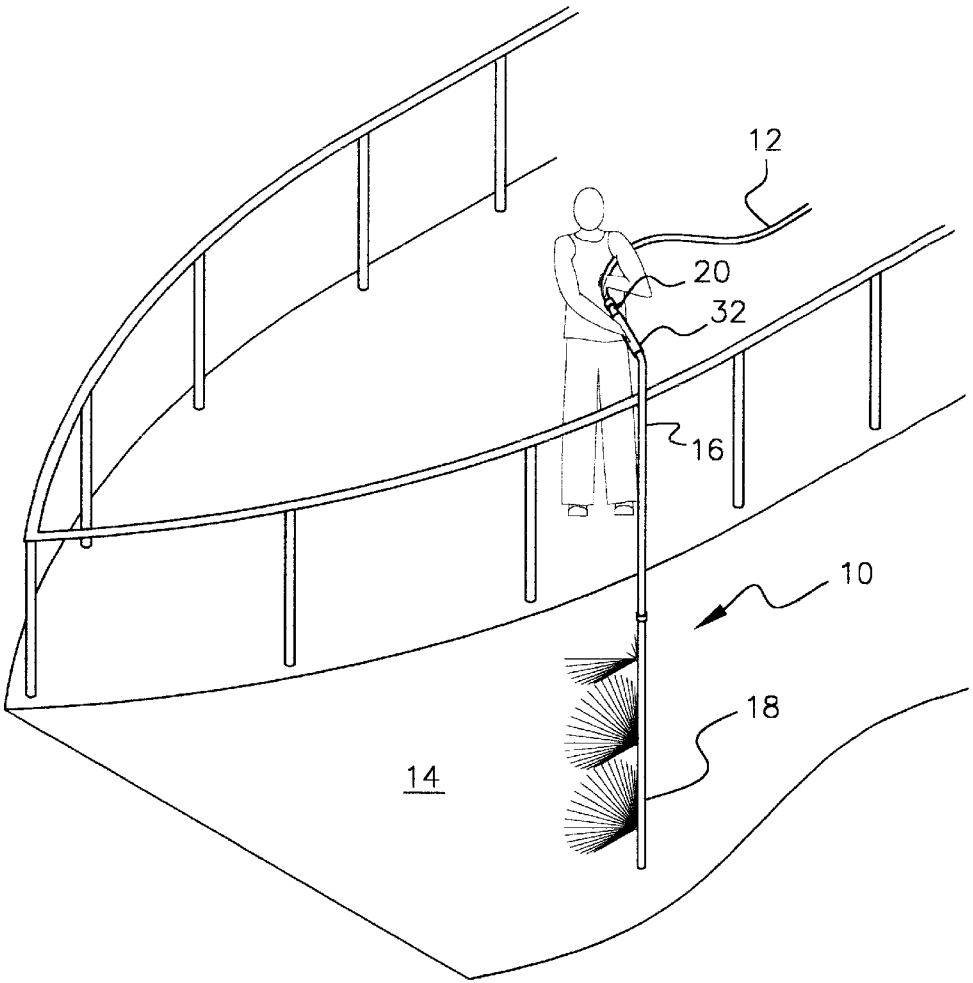
FIG. 1 is a perspective view of the spray wand of the present invention illustrating how it can used to clean boat hulls.

Throughout the following detailed description, the same reference numerals refer to the same elements in all figures.

Referring to FIG. 1, a liquid spray wand 10 of the present invention is shown. Spray wand 10 can be used to spray any free flowing liquid, such as, for example, water. In the preferred embodiment, spray wand 10 is used to spray water, and in particular, fresh water. Accordingly, spray wand 10 attaches to a water source (not shown) by means of a flexible water hose 12. A typical garden hose can be employed for hose 12. Spray wand 10 is intended to be used to clean a boat hull 14. Although spray wand 10 could be used to clean surfaces of other structures, its unique design permits it to rinse and clean a boat hull 14 quickly, easily and thoroughly.

Figure 2:
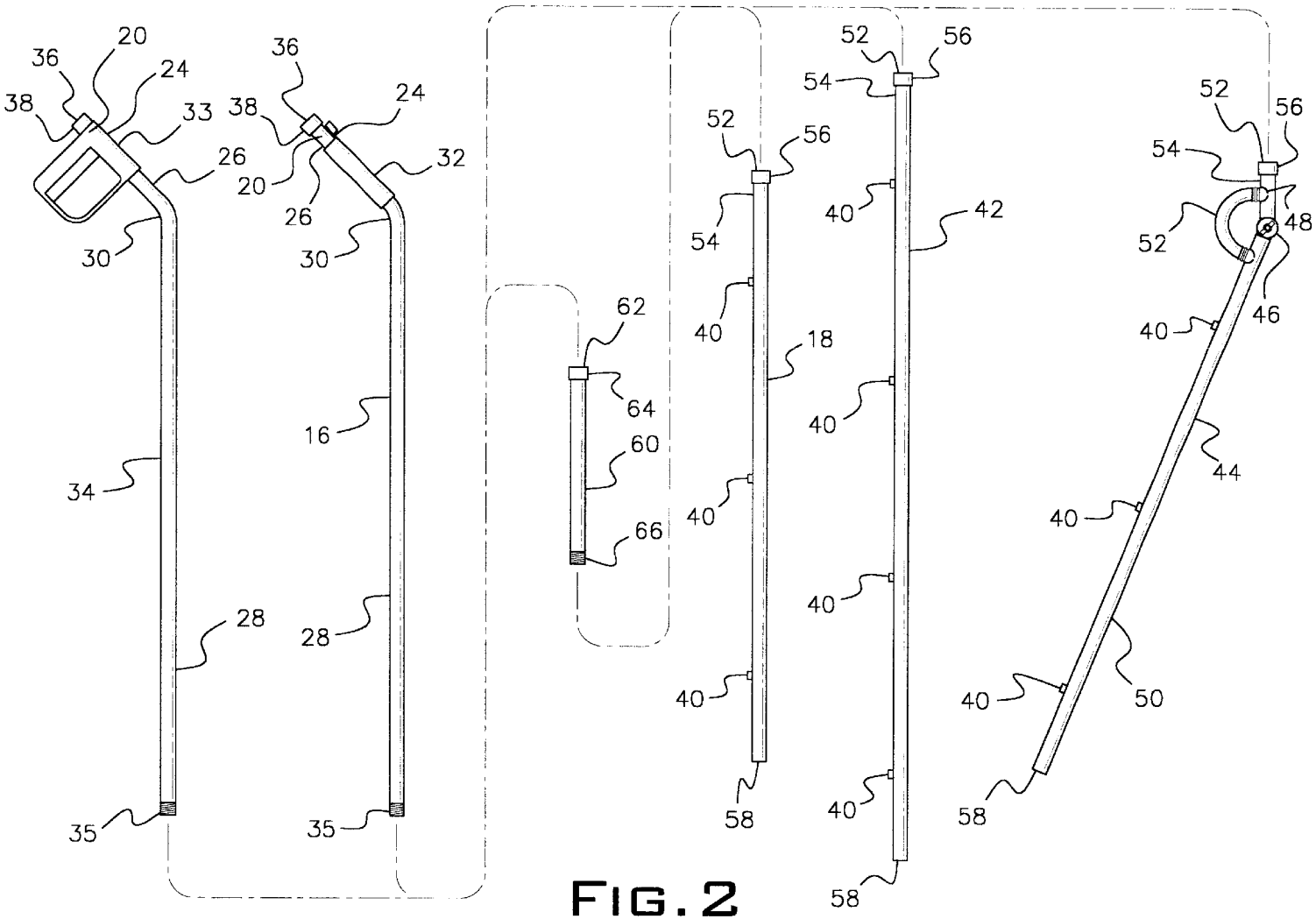
FIG. 2 is a side elevational view of the present invention illustrating a preferred and an alternate handle portion, a preferred and two alternate wand portions, an extension portion and how each portion can connect thereto.
Figure 4:
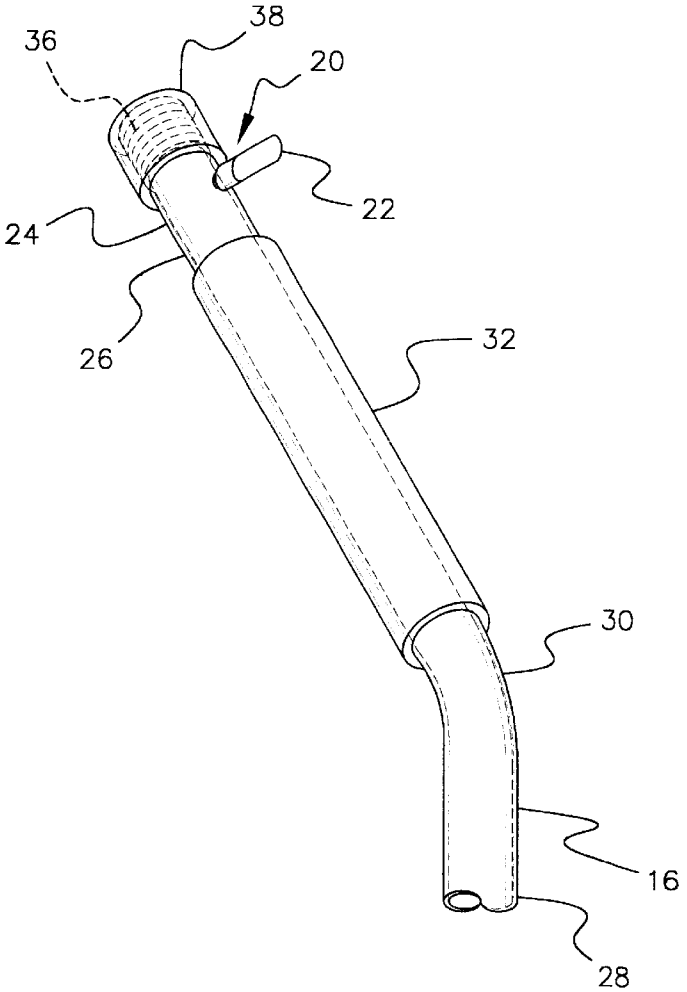
FIG. 4 is a detail perspective view of the preferred handle portion of the novel spray wand of the present invention illustrating how the shut-off valve is in a closed position.
Figure 3:
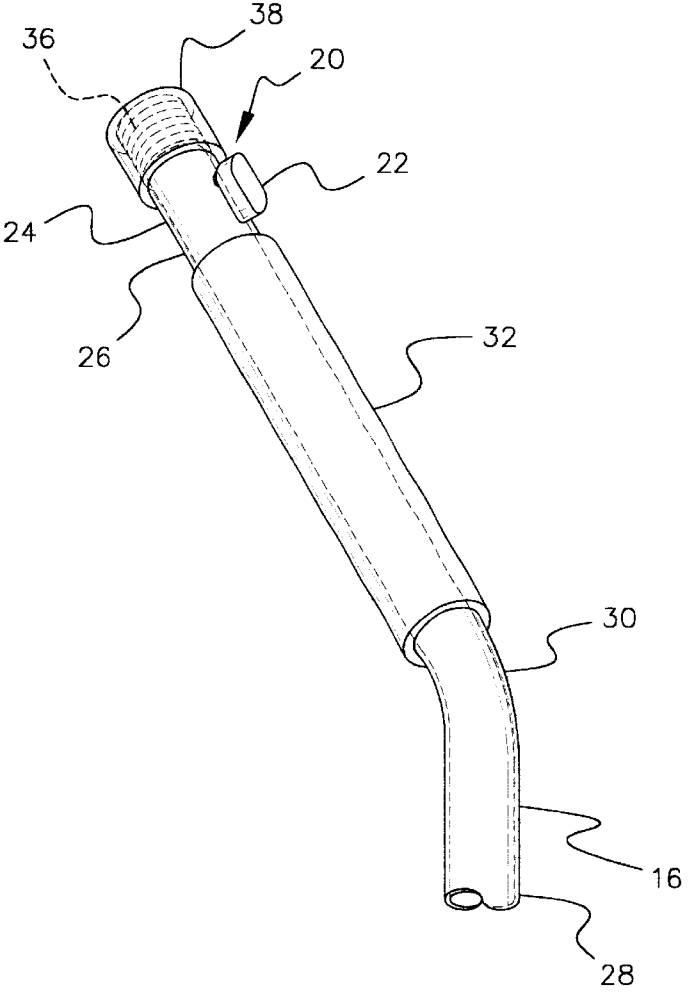
FIG. 3 is a detail perspective view of the preferred handle portion of the novel spray wand of the present invention illustrating how a shut-off valve is in an open position.

Referring to FIG. 2, spray wand 10, in its preferred embodiment, employs two primary portions, including an angled handle portion 16 and a wand portion 18. However, as shown in FIG. 2, alternate portions can be added or substituted for those used in the preferred spray wand. Referring to FIGS. 3 and 4, preferred handle portion 16 includes a shut-off valve 20, which is opened and closed by a turn knob 22 located near a top end 24 of an upper portion 26 of handle portion 16. FIG. 3 illustrates valve 20 in its open position, whereas FIG. 4 illustrates valve 20 in its closed position.

With continuing reference to FIG. 2, it is shown that preferred handle portion 16 is constructed as a continuous cylindrical tube having a channel formed therein for permitting the passage of water therethrough. Upper portion 26 is integral with a bottom portion 28 and is separated by an angled portion 30. Although not shown, angled portion 30, in an alternate embodiment, can be adjustable. In the preferred embodiment, angled portion is set at about 45°. It is appreciated though that other pre-set angles could be employed in the preferred embodiment. A hand grip 32, positioned around upper portion 26, is made from a soft pliable material and is about seven inches in length. Handle portion 16 is constructed of a lightweight, high impact resistant material such as PVC or high-strength aluminum.

With continuing reference to FIG. 2, an alternate handle portion 34 can be substituted for preferred handle portion 16. As depicted, alternate handle portion 34 has all of the same features of preferred handle portion 16 except that the shut-off valve is activated by a trigger handle 33 and no hand grip 32 is employed. Both preferred and alternate handle portions, 16 and 34 respectively, have a threaded opening 36 and a collar member 38 surrounding opening 36 for engaging a threaded coupler (not shown) of hose 12. The size of opening 36 can vary, for example, from ½" to 1" depending on the size of the coupler on hose 12. Preferred and alternate handle portions, 16 and 34 respectively, also include an open threaded bottom end coupler 35 for engaging wand portion 18.

As shown in FIG. 2, in its preferred embodiment, wand portion 18 has three spray nozzles 40. However, it is understood that nothing herein limits the number of nozzles 40 which can be employed. Preferred wand portion 18 is a three foot elongated non-adjustable cylindrical tube having a channel formed therein for permitting the passage of water through the wand and out spray nozzles 40. Preferred wand portion 18 is ideally used with vessels having a length in the range of twenty-five to forty feet. For larger vessels, such as, for example, those having a length of forty to fifty-five feet, preferred wand portion 18 can be substituted for a first alternate wand portion 42 having four spray nozzles 40. Again, nothing herein limits the number spray nozzles 40 that can be employed with first alternate wand portion 42. First alternate wand portion 42 is a four foot elongated non-adjustable cylindrical tube having a channel formed therein for permitting the passage of water through the wand and out spray nozzles 40. For vessels with a deep V-style hull, a second alternate wand portion 44 can be employed having, in its preferred form, three spray nozzles 40. However, once again, nothing herein limits the number of spray nozzles 40 that can be employed with second alternate wand portion 44. Second alternate wand portion 44 utilizes a two-part construction wherein an adjustable angled portion 46 separates an upper portion 48 and a lower portion 50. A flexible tube 52 connects channels formed in each upper and lower portion, 48 and 50 respectively. The channels permit water to pass through the wand and out spray nozzles 40. Angled portion 44 is adjustable and utilizes opposing off-set saw-tooth like projections that are loosen by a nut, moved to the desired angle and then re-tighten by the nut. In its preferred form, second alternate wand portion lower portion 48 is about three feet in length and has three spray nozzles 40.

As shown in FIG. 2, each wand portion, 18, 42 and 44, employs a threaded opening 52 at a top end 54 which is surrounded by a collar member 56 for engaging open threaded bottom end coupler 35 of the handle portion. Also common to each wand portion, 18, 42 and 44, is a closed bottom end 58. Wand portion 18, 42 or 44 is constructed of the same lightweight, high impact resistant material, such as PVC or high-strength aluminum, as is handle portion 18 or 34.

For other vessels, regardless of the hull style, an extension piece 60 can be inserted in between handle portions 16 or 34 and wand portions 18, 42 and 44, as shown in FIG. 2. In its preferred form, extension piece 60 is a one foot elongated cylindrical tube having a channel formed therein for permitting water to pass through extension piece 60 from handle portion 16 or 34 and into wand portion 18, 42 or 44. Extension piece 60 further includes a threaded opening 62 surrounded by a collar member 64 and an open threaded bottom end 66. Extension piece threaded opening 62 engages handle portion open threaded bottom end 35 and extension piece open threaded bottom end 66 engages wand portion threaded opening 52. Extension piece 60 is constructed of the same lightweight, high impact resistant material, such as PVC or high-strength aluminum, as is handle portion 16 or 34 and wand portion 18, 42 or 44. Extension piece 60 is typically employed when the vessel is above forty feet and is a sport fishing or motor yacht style of vessel.

Figure 5:
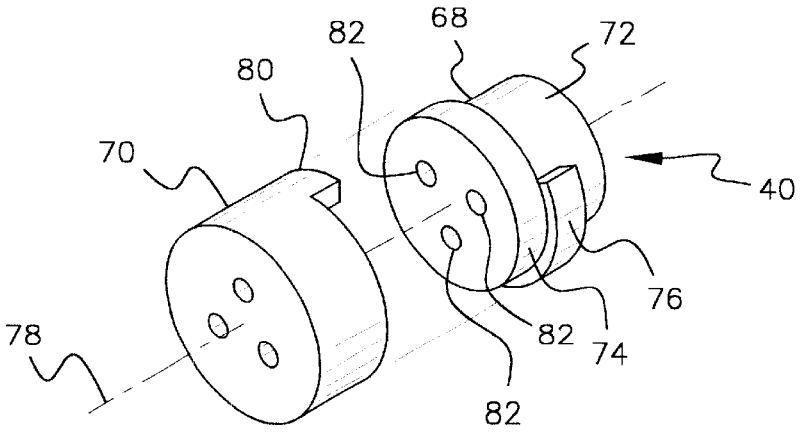
FIG. 5 is an exploded perspective view of a spray nozzle employed in the novel spray wand of the present invention.
Figure 6:
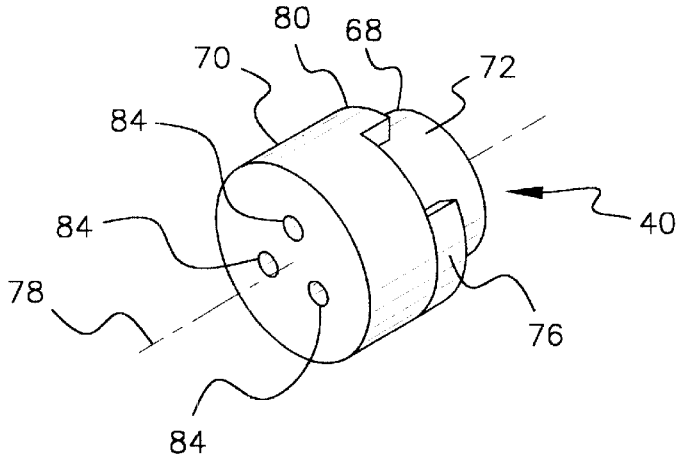
FIG. 6 is a perspective view of the spray nozzle in its closed position.
Figure 7:
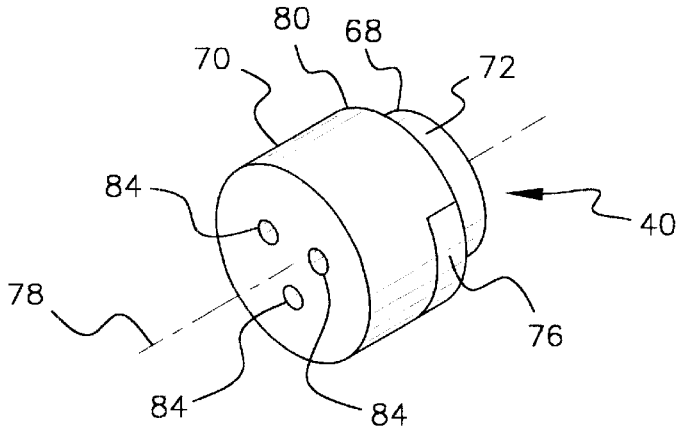
FIG. 7 is a perspective view of the spray nozzle in its open position.

Referring to FIGS. 5–7, it is shown that each spray nozzle 40 includes a first and second portion, 68 and 70. First portion 68 has a cylindrical bottom half 72 integral with a cylindrical top half 74. An outer circumference of top half 74 is greater than an outer circumference of bottom half 72. Nozzle first portion bottom half 72 inserts within apertures (not shown) formed in wand portion 18, 42 or 44. First portion 68 further includes a first crescent-shaped section 76 integrally mounted along the outer circumference of bottom half 72, juxtaposed to top half 74, such that it protrudes above the outer circumference of top half 74.

With continuing reference to FIGS. 5–7, second portion 70 mates with first portion 68 and is rotatable about a central axis 78. Second portion 70 includes a second reciprocal crescent-shaped section 80 which slides over first portion top half 74 and mates with first crescent-shaped section 76 when second portion 70 is rotated about center axis 78 in a clockwise direction. When nozzle second portion 70 is mounted over nozzle first portion and rotated such that first and second crescent-shaped sections 76 and 80 mate, a first set of apertures 82 formed in nozzle first portion 68 axially align with a second set of apertures 84 formed in nozzle second portion 70, as shown in FIG. 7. When apertures 82 and 84 axially align, liquid passing through spray wand 10 sprays out of nozzle 40. When apertures 82 and 84 are off-set, as shown in FIG. 6, liquid is prohibited from spraying out of nozzle 40. Although not shown, however if desired, nozzles 40 can be formed as a single integral unit wherein the apertures are permanently aligned along their respective axis.

Figure 8:
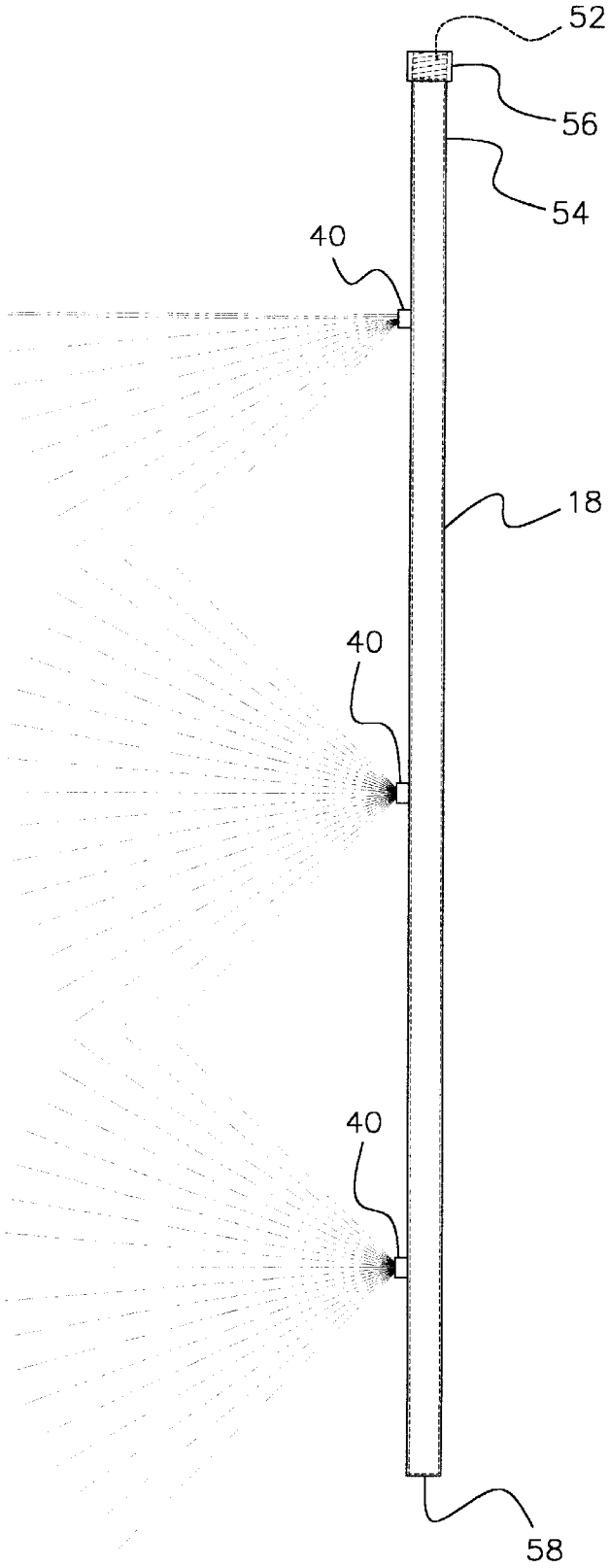
FIG. 8 is a side elevational view of the preferred wand portion of the novel spray wand of the present invention illustrating the unique liquid spray pattern that sprays from the nozzles in the wand portion.

Referring to FIG. 8, preferred wand portion 18 is shown spraying a liquid, such as, for example, water, from out of nozzles 40. The spray pattern shown therein is the preferred pattern. Accordingly, a top nozzle, that which is disposed proximal to wand portion top end 54, sprays liquid at a 180° pattern, whereas all other nozzles therebelow spray liquid at a 360° pattern. This ensures that the user of spray wand 10 does not get wet while using the device (also seen in FIG. 1).

As now appreciated, a novel spray wand 10 for cleaning boat hulls is disclosed. Referring back to FIG. 1, it can be seen that a user attaches spray wand 10 to a water source by a hose 12. Thereafter, the user walks around the deck of the boat while positioning spray wand 10 over the side of the vessel such that nozzles 40 point towards hull 14. The user is not required to bend over, but instead can merely hold spray wand 10 parallel to hull 14 as water sprays therefrom. After rinsing hull 14, shut-off valve 20 can be used to stop the flow of water. The source of water is then shut-off, whereafter spray wand 10 can be disconnected from hose 12 and disassembled for easy storage and later use.

Equivalent elements can be substituted for the ones set forth above such that they perform the same function in the same way for achieving the same result.

Having thus described the invention what is claimed and desired to be secured by Letters Patent is:

1. A liquid spray device for cleaning a surface area, the spray device capable of connecting to a liquid source, the spray device comprising:

a) a cylindrical handle portion having an upper and lower portion separated by an angled portion, a channel formed therethrough and an open top and bottom end, the open top end engaging an open terminal end of a hose connected to the liquid source, b) a shut-off valve disposed within the handle portion channel proximal to the open top end and controllable by a finger actuation device, the shut-off valve prohibiting the flow of liquid from the liquid source to the spray device when the shut-off valve is in a closed position, c) a cylindrical wand portion having a channel formed therethrough, an open top end and a closed bottom end, the wand portion open top end engaging the handle portion open bottom end such that the wand portion channel axially aligns with the handle portion channel permitting liquid to flow from the handle portion into the wand portion, and d) a plurality of spray nozzles inserted within apertures formed in the wand portion permitting the liquid flowing through the spray device to spray out from the spray nozzles at the surface area to be cleaned, a first spray nozzle of the plurality of spray nozzles spraying a different liquid stream pattern than the remaining plurality of spray nozzles, the different liquid stream pattern of the first spray nozzle being a 180° liquid stream pattern.

2. The liquid spray device of claim 1, further comprising a hand grip mounted about the handle upper portion, the hand grip constructed of a soft pliable material.

3. The liquid spray device of claim 1, wherein the handle portion open top end is a threaded opening and the handle portion open bottom end is a threaded coupler.

4. The liquid spray device of claim 3, further comprising a first collar member surrounding the handle portion open top end threaded opening.

5. The liquid spray device of claim 1, wherein the shut-off valve finger actuation device is a turn-knob.

6. The liquid spray device of claim 1, wherein the shut-off valve finger actuation device is a trigger handle mechanism.

7. The liquid spray device of claim 1, wherein the wand portion open top end is a threaded opening.

8. The liquid spray device of claim 7, further comprising a second collar member surrounding the wand portion open top end threaded opening.

9. The liquid spray device of claim 1, wherein the wand portion comprises an upper portion, a lower portion, an angled portion and a flexible tube connecting the channel formed in the wand portion between the wand upper and lower portions.

10. The liquid spray device of claim 1, wherein at least three spray nozzles are employed.

11. The liquid spray device of claim 1, wherein the first spray nozzle is a top spray nozzle of the plurality of spray nozzles disposed proximal to the wand portion open top end.

12. The liquid spray device of claim 1, wherein the handle angled portion is set at 45°.

13. A liquid spray device for cleaning a surface area, the spray device capable of connecting to a liquid source, the spray device comprising:

a) a cylindrical handle portion having an upper and lower portion separated by an angled portion, a channel formed therethrough and an open top and bottom end, the open top end engaging an open terminal end of a hose connected to the liquid source, b) a shut-off valve disposed within the handle portion channel proximal to the open top end and controllable by a finger actuation device, the shut-off valve prohibiting the flow of liquid from the liquid source to the spray device when the shut-off valve is in a closed position, c) a cylindrical wand portion having a channel formed therethrough, an open top end and a closed bottom end, the wand portion open top end engaging the handle portion open bottom end such that the wand portion channel axially aligns with the handle portion channel permitting liquid to flow from the handle portion into the wand portion, and d) a plurality of spray nozzles inserted within apertures formed in the wand portion permitting the liquid flowing through the spray device to spray out from the spray nozzles at the surface area to be cleaned, each of the plurality of spray nozzles comprising a first and second portion, each first and second portion having a plurality of apertures formed therein, each spray nozzle first portion comprising a cylindrical bottom and top half, each spray nozzle first portion cylindrical top half having a greater circumference than each spray nozzle first portion cylindrical bottom half, each spray nozzle first portion cylindrical bottom half having a first crescent-shaped portion integrally attached proximal to each spray nozzle first portion cylindrical top half, each spray nozzle second portion having a second crescent-shaped portion for sliding over each spray nozzle first portion top half, the plurality of apertures formed in each spray nozzle first and second portion axially aligning when each spray nozzle second portion is rotated in a clockwise direction such that each first and second crescent-shaped portions mate.

14. A water spray device connected to a water source by a hose for cleaning a hull of a boat, the water spray device comprising:

a) a cylindrical handle portion having an upper and lower portion separated by an angled portion, a channel formed therethrough, a top threaded opening, a first collar member surrounding the top threaded opening and a bottom threaded coupler, the top threaded opening engaging an open threaded terminal end of the hose, b) a shut-off valve disposed within the handle portion channel proximal to the top threaded opening and controllable by a finger actuation device, the shut-off valve prohibiting the flow of water from the water source to the spray device when the shut-off valve is in a closed position, c) a cylindrical wand portion having a channel formed therethrough, a top threaded opening, a second collar member surrounding the top threaded opening and a closed bottom end, the wand portion top threaded opening engaging the handle portion bottom threaded coupler such that the wand portion channel axially aligns with the handle portion channel permitting water to flow from the handle portion into the wand portion, and d) at least three spray nozzles inserted within apertures formed in the wand portion permitting the water to spray out from the spray nozzles at the boat hull to be cleaned, a first spray nozzle of the at least three spray nozzles spraying a different water stream pattern than the remaining spray nozzles, the different water stream pattern of the first spray nozzle being a 180° water stream pattern.

15. The water spray device of claim 14, further comprising a hand grip mounted about the handle upper portion, the hand grip constructed of a soft pliable material.

16. The water spray device of claim 14, wherein the shut-off valve finger actuation device is chosen from the group including a turn-knob and a trigger handle mechanism.

17. The water spray device of claim 14, wherein the wand portion comprises an upper portion, a lower portion, an angled portion and a flexible tube connecting the channel formed in the wand portion between the wand upper and lower portions.

18. The water spray device of claim 14, wherein the first spray nozzle is a top spray nozzle of the at least three spray nozzles disposed proximal to the wand portion top threaded opening.

19. The water spray device of claim 14, wherein the handle angled portion is set at 45°.

20. A water spray device connected to a water source by a hose for cleaning a hull of a boat, the water spray device comprising:

a) a cylindrical handle portion having an upper and lower portion separated by an angled portion, a channel formed therethrough, a top threaded opening, a first collar member surrounding the top threaded opening and a bottom threaded coupler, the top threaded opening engaging an open threaded terminal end of the hose, b) a shut-off valve disposed within the handle portion channel proximal to the top threaded opening and controllable by a finger actuation device, the shut-off valve prohibiting the flow of water from the water source to the spray device when the shut-off valve is in a closed position, c) a cylindrical wand portion having a channel formed therethrough, a top threaded opening, a second collar member surrounding the top threaded opening and a closed bottom end, the wand portion top threaded opening engaging the handle portion bottom threaded coupler such that the wand portion channel axially aligns with the handle portion channel permitting water to flow from the handle portion into the wand portion, and d) at least three spray nozzles inserted within apertures formed in the wand portion permitting the water to spray out from the spray nozzles at the boat hull to be cleaned, each spray nozzle comprising a first and second portion, each first and second portion having a plurality of apertures formed therein, each spray nozzle first portion comprising a cylindrical bottom and top half, each spray nozzle first portion cylindrical top half having a greater circumference than each spray nozzle first portion cylindrical bottom half, each spray nozzle first portion cylindrical bottom half having a first crescent-shaped portion integrally attached proximal to each spray nozzle first portion cylindrical top half, each spray nozzle second portion having a second crescent-shaped portion for sliding over each spray nozzle first portion top half, the plurality of apertures formed in each spray nozzle first and second portions axially aligning when each spray nozzle second portion is rotated in a clockwise direction such that each first and second crescent-shaped portions mate.

* * * * *